United States Patent [19]

Zückler

[11] 4,450,330

[45] May 22, 1984

[54] ELECTRIC SWITCH WITH TWO QUENCHING NOZZLES HAVING AN IMPROVED QUENCHING MEDIUM FLOW

[75] Inventor: Karl Zückler, Berlin, Fed. Rep. of Germany

[73] Assignee: Siemens Aktiengesellschaft, Munich, Fed. Rep. of Germany

[21] Appl. No.: 410,064

[22] Filed: Aug. 20, 1982

[30] Foreign Application Priority Data

Aug. 27, 1981 [DE] Fed. Rep. of Germany ..... 3134200

[51] Int. Cl.³ ..... H01H 33/70

[52] U.S. Cl. ..... 200/148 A; 200/150 G

[58] Field of Search ..... 200/148 R, 148 A, 148 B, 200/150 G

[56] References Cited

U.S. PATENT DOCUMENTS 4,278,860 7/1981 Wu ..... 200/148 R

FOREIGN PATENT DOCUMENTS 1966973 12/1977 Fed. Rep. of Germany .

OTHER PUBLICATIONS

"IEEE Transactions on Power Apparatus and System", vol. PAS-99, No. 3, May/Jun. 1980.

*Primary Examiner*—E. A. Goldberg
*Assistant Examiner*—Morris Ginsburg
*Attorney, Agent, or Firm*—Kenyon & Kenyon

[57] ABSTRACT

An electric switch includes two quenching nozzles which are arranged opposite each other at the distance of the switching gap; a contact tube; a guide tube and a longitudinally movable switching tube for bridging the switching gap which is coupled, together with a movable pressure piston of a pressure piston/pressure cylinder arrangement provided for generating a quenching medium flow acting on the arc, to a common drive. In order to improve such a switch still further with respect to the quenching medium flow, the pressure piston is connected rigidly to the switching tube and is arranged in a stationary pressure cylinder which is connected in the region of its end surrounding the contact tube via passage openings in the contact tube to the interior of the latter. The pressure piston is connected rigidly to a suction piston in a suction cylinder which is connected in the region of its end facing the pressure cylinder, via holes in the guide tube, to the interior thereof.

6 Claims, 1 Drawing Figure

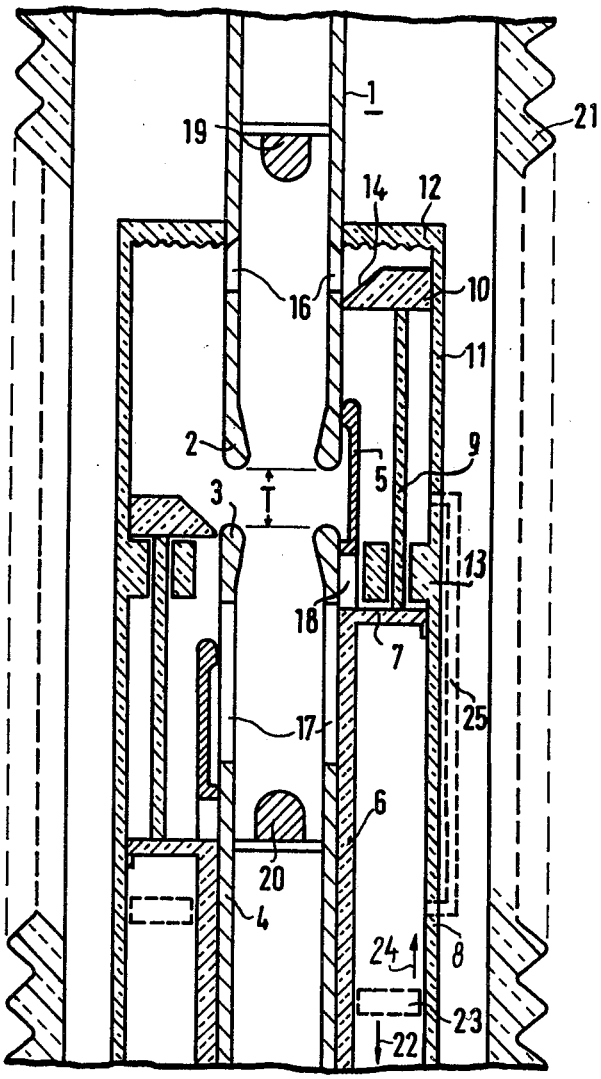
1
21
19
14
12
16
10
11
2
9
5
3
T
13
18
7
25
17
6
20
4
24
8
23
22

ELECTRIC SWITCH WITH TWO QUENCHING NOZZLES HAVING AN IMPROVED QUENCHING MEDIUM FLOW

BACKGROUND ON THE INVENTION

This invention relates to electric switches in general and more particularly to an improved switch of the type which has apparatus for quenching an arc with a quenching gas.

An electric switch with two quenching nozzles arranged opposite each other at the distance of the switching gap, one of which is mounted at a stationary contact tube and the other at a stationary guide tube, with a longitudinally movable switching tube for bridging the switching gap, and with a pressure piston/pressure cylinder arrangement for generating a quenching medium flow acting on the arc, and in which the switching tube and the movable pressure piston of the pressure piston/pressure cylinder arrangement are coupled to a common drive, is described in DE-AS No. 19 66 973.

In this known electric switch the pressure cylinder of the pressure piston/pressure cylinder arrangement is arranged movably in the longitudinal direction and is coupled rigidly to the switching tube and the drive. During the breaking motion, the pressure cylinder is therefore moved, together with the switching tube, in a direction toward the pressure piston of the pressure piston/pressure cylinder arrangement. In the course of the breaking motion, the pressure piston is also set in motion by the drive, its motion being opposed to that of the pressure cylinder. Thereby, a compression or an improvement of the precompression is obtained during the breaking process particularly quickly.

It is an object of the present invention to further improve this known electric switch with respect to the quenching medium flow, where this improvement should be attainable with a simple mechanical design and low manufacturing cost.

SUMMARY OF THE INVENTION

For solving this problem, the pressure piston is connected, according to the present invention, in an electric switch of the type described above, rigidly to the switching tube and is arranged in a stationary pressure cylinder; the pressure cylinder is connected to the interior of the contact tube in the region of its end surrounding the contact tube, via passage openings in the contact tube, and the pressure piston is connected rigidly to a suction piston in a stationary suction cylinder surrounding the guide tube. The suction cylinder is connected, in the region of its end facing the pressure cylinder, to the interior of the pressure cylinder, via holes in the guide tube.

An essential advantage of the switch according to the present invention is seen in its relatively simple design; this applies in particular to the design of the drive. It is a further advantage of the switch according to the present invention that, in spite of a short precompression travel distance, a large pressure difference is generated at the quenching nozzles. This is due to the fact that, in the region outside the quenching nozzles, an overpressure is produced during the precompression, and at the same time, an underpressure is being built up within the quenching nozzles, which is brought about by the motion of the pressure piston and the suction piston during the precompression phase. The relatively large pressure difference obtained thereby leads to a strong quenching medium flow, which leads to an advantageously short quenching time of the arc. It is a further advantage that the relatively large pressure difference is built up relatively quickly so that the switch according to the present invention is enabled to quench the arc relatively early.

While it is known already ("IEEE Transactions on Power Apparatus and Systems", vol. PAS 99, no. 3, May/June 1980) in an electric switch, for shortening the precompression time and for increasing the pressure difference for the quenching medium flow of the pressure piston/pressure cylinder arrangement, to also associate, with a suction cylinder with a movable suction piston, a stationary, rod-shaped contact which cooperates with a movable, hollow contact piece with a quenching nozzle, in this known electric switch, during the switching off motion, an underpressure is built up in the interior of the movable contact part by means of the suction piston and the suction cylinder, in addition to the overpressure acting on the switching gap from the outside. In the known switch, underpressure therefore occurs only in the interior of the movable contact, so that underpressure with respect to the switching gap is generated only from one side. In the switch according to the present invention, however, underpressure is generated in the vicinity of both quenching nozzles.

It has been found advantageous in the switch according to the present invention if flow obstacles are arranged in the contact tube and in the guide tube. These are always disposed on the side of the passage openings and holes facing away from the quenching nozzles. Such flow obstacles are advantageous particularly if the flow cross sections in the interior of the contact tube and the guide tube are relatively large. These flow obstacles inhibit, in a desired manner, the suction flow for the low pressure space in the direction toward the switching gap of the switch.

In the switch according to the present invention, the pressure cylinder of the pressure piston/pressure cylinder arrangement and also the suction cylinder may each consist, by itself, of a separate part. Particularly for manufacturing reasons it appears advantageous, however, if the pressure cylinder and the suction cylinder consist of a single cylinder part with a ring shaped partition. By means of this ring shaped partition, the single cylinder part is divided into the pressure cylinder and the suction cylinder.

It is furthermore considered advantageous if the interior of the pressure cylinder is connected to the interior of the suction cylinder via an external pressure line. With this pressure line, care is taken that the pressure in the interior of the pressure cylinder corresponds to that in the interior of the suction cylinder.

Connecting the interiors of the pressure cylinder and the suction cylinder via the pressure line is particularly advantageous if the suction cylinder has, at its end facing away from the pressure cylinder, a counterpiston which executes, in the course of the breaking motion of the drive, a motion in the opposite direction toward the suction piston, controlled by the former. In this case, as is explained in detail in DE-AS No. 19 66 973, particularly high precompression is obtained which is imparted via the pressure line to the interior of the pressure cylinder, whereby the pressure difference in the region of the switching gap and therefore, the quenching medium flow are improved further.

However, it is also possible to terminate the suction cylinder with a stationary bottom at its end facing away from the pressure cylinder in the switch according to the present invention. This design is advantageous inasmuch as it requires only a relatively simply drive.

BRIEF DESCRIPTION OF THE DRAWINGS

The single FIGURE is a cross sectional schematic view of a switch according to the present invention, the right-hand side of the FIGURE showing the switch in the closed state, and the left-hand side of the FIGURE showing the switch in the off condition.

DETAILED DESCRIPTION

The electric switch shown contains a stationary contact tube 1 with a quenching nozzle 2, opposite which a quenching nozzle 3 of a likewise stationary guide tube 4 is arranged. The switching gap T formed by the quenching nozzles 2 and 3 can be bridged by a switching tube 5 which is part of a drive cylinder 6. This drive cylinder 6 is connected to a drive in a manner not shown.

A suction piston 7 which can move in a suction cylinder 8, is fastened to the drive cylinder 6. To the suction piston 7 is connected, via connecting rods, of which only one connecting rod 9 is shown in the FIGURE, a pressure piston 10 which is guided in a pressure cylinder 11. The pressure piston 10, the suction piston 7, the switching tube 5 and the drive cylinder 6 are thus coupled mechanically to each other in a rigid manner. The pressure cylinder 11 and the suction cylinder 8 consist of a single cylinder part which consists of insulating material and is provided, at the end enclosing the contact tube 1, with ribs 12 for extending the leakage path. The single insultating part is subdivided by a ring-shaped partition 13 into the suction cylinder 8 and the pressure cylinder 11.

The pressure piston 10 is provided with a bevel 14 on its inner circumference so that passage openings 16 of the contact tube 1 are left free, even if the switch is in the closed condition. There are also holes 17 in the guide tube 4 which connect the interior of the guide tube 4 to the interior of the suction cylinder 8. The switching piece 5 is also provided with perforations 18.

In the contact tube 1, a flow obstacle 19 is disposed on that side of the passage openings 16, which is facing away form the quenching nozzle 2. A further flow obstacle 20 is provided in the guide tube 4, likewise in the region outside the hole 17.

The entire electric switch is housed in a porcelain insulator 21 in a manner known per se.

The switch according to the present invention, as illustrated by the embodiment of the FIGURE operates as follows: due to operation by the drive, not shown, the drive cylinder 6 is moved in the direction of the arrow 22; thereby, the suction piston 7 fastened to it and, via the connecting rod 9, the pressure piston 10 are also moved in the direction of the arrow 22, taking along the switching tube 5 which is likewise coupled rigidly to the drive cylinder 6. During the motion of the pressure piston 10, not only is the insulating gas which is within the porcelain insulator 21 for insulating purposes compressed in the interior of the pressure cylinder 11, but, at the same time, insulating gas is suctioned off by the pressure piston 10 through the passage openings 16 from the interior of the contact tube 1; the flow obstacle 19 prevents too much insulating gas flowing out from the low pressure space of the switch. At the same time, the switching tube 5 with its perforations 18 also arrives at the region of the holes 17 of the guide tube 4 so that insulating gas is also suctioned by the suction piston 7 from the interior of the guide tube 4, and thereby, an underpressure is also produced on this side of the switching gap T. Thus, a contribution to the generation of underpressure is made from both sides of the switching gap T.

The pressure increase in the interior of the pressure cylinder 11 and the generation of underpressure in the interior of the contact tube 1 and the guide tube 4 last until the switching tube 5 is separated from the quenching nozzle 2 of the contact tube 1, drawing an arc. At this moment, a high pressure difference is formed between the interior of the pressure cylinder 11 and the interior spaces of the contact tube 1 and the guide tube 4; this pressure difference results from the pressure increase in the interior of the pressure cylinder 11 and the underpressure inside the contact tube 1 and the guide tube 4. A strong quenching medium flow therefore sets in which extinguishes the arc relatively quick. Thereby, a short overall quenching time is achieved in spite of a relatively short quenching travel path, and makes it possible for the switch to switch off in a short time. As shown in the FIGURE by broken lines, the cylinder 8 can be terminated not only by a fixed bottom but by a counter piston 23 on its side facing away from the pressure cylinder 11. This counter piston 23 may be connected to the drive of the switch in a manner such as shown in DE-AS No. 19 66 973 in detail. The counter piston 23 is thus moved, during the off motion, in the direction of the arrow 24 and therefore causes in the interior of the suction cylinder 8, together with the suction piston 7, an additional compression of the insulating gas. If a pressure line 25 is provided between the interior of the suction cylinder 8 and the pressure cylinder 11, this pressure is transmitted to the interior of the pressure cylinder 11 and causes a further pressure increase in the cylinder 11. This has an advantageous effect on the quenching medium flow and the dielectric strength of the switching gap when the switching tube 5 is separated from the quenching nozzle 2 of the contact tube 1.

I claim:

1. In an electric switch including: two quenching nozzles arranged opposite each other to form a switching gap distance, across which an arc is generated during switching, one of which is mounted at a stationary contact tube and the other at a stationary guide tube; a longitudinally movable switching tube for bridging the switching gap; a pressure piston/pressure cylinder arrangement, including a movable pressure piston, for generating a quenching medium flow acting on the arc; and a common drive to which the switching tube and the movable pressure piston of the pressure piston/pressure cylinder arrangement are coupled, the improvement comprising: the pressure cylinder being a stationary pressure cylinder one end of which surrounds the contact tube, the pressure piston being rigidly connected to the switching tube and disposed in said stationary pressure cylinder; passage openings in the contact tube connecting the pressure cylinder in the region of its end surrounding the contact tube, to the interior of the contact tube; a suction cylinder having one end facing the pressure cylinder, a suction piston in said suction cylinder, the pressure piston being connected rigidly to said suction piston, said suction cylinder being stationary and surrounding the guide tube;

and holes in said guide tube connecting said suction cylinder, in the region of its end facing the pressure cylinder, to the interior thereof.

2. The improvement according to claim 1 and further including flow obstacles disposed in the contact tube and the guide tube on the respective side of the passage openings, said holes facing away from the quenching nozzles.

3. The improvement according to claim 1, wherein said pressure cylinder and said suction cylinder comprise a single cylinder part with a ring-shaped partition.

4. The improvement according to claim 1, and further including an external pressure line connecting the interior of the pressure cylinder to the interior of the suction cylinder.

5. The improvement according to claim 1, wherein the pressure cylinder is terminated by a stationary bottom at its end facing away from the pressure cylinder.

6. The improvement according to one of the claims 1 to 4, and further including an outer piston at the end of said suction cylinder facing away from the pressure cylinder, said outer piston executing, in the course of the opening motion of the drive, a motion in the direction opposed to the motion of the suction piston, controlled thereby.

* * * * *